US012740657B2

(12) United States Patent
Hachmann

(10) Patent No.: US 12,740,657 B2
(45) Date of Patent: Sep. 22, 2026

(54) GOODS PRESENTATON SYSTEM WITH AT LEAST ONE SEPARATING ELEMENT

(71) Applicant: INVENTORY SYSTEMS GMBH, Berlin (DE)

(72) Inventor: Georg Hachmann, Berlin (DE)

(73) Assignee: INVENTORY SYSTEMS GMBH, Berlin (DE)

( * ) Notice: Subject to any disclaimer, the term of this patent is extended or adjusted under 35 U.S.C. 154(b) by 124 days.

(21) Appl. No.: 18/822,387

(22) Filed: Sep. 2, 2024

(65) Prior Publication Data

US 2026/0060451 A1 Mar. 5, 2026

(51) Int. Cl.
*A47F 1/08* (2006.01)
*A47F 5/10* (2006.01)

(52) U.S. Cl.
CPC ..... *A47F 1/08* (2013.01); *A47F 5/105* (2013.01)

(58) Field of Classification Search
CPC ..... A47F 1/08; A47F 1/10; A47F 1/12; A47F 1/125; A47F 5/105
See application file for complete search history.

(56) References Cited

U.S. PATENT DOCUMENTS 3,912,084 A 10/1975 Valiulis
4,394,909 A 7/1983 Valiulis et al.
5,634,564 A * 6/1997 Spamer ..... A47F 1/126 211/59.3
5,706,958 A 1/1998 Spamer
6,076,670 A * 6/2000 Yeranossian ..... A47F 1/126 221/124
7,768,399 B2 8/2010 Hachmann et al.
11,627,819 B1 * 4/2023 Fink ..... A47F 1/12 211/59.3
12,004,664 B2 * 6/2024 Campbell ..... G07F 11/60
2011/0240569 A1 * 10/2011 Kahl ..... A47F 7/285 221/253

(Continued)

FOREIGN PATENT DOCUMENTS

AU 2010201582 A1 11/2010
CN 103231914 A 8/2013

(Continued)

OTHER PUBLICATIONS

International Search Report dated Nov. 20, 2025, as received in application No. PCT/EP2025/074381.

*Primary Examiner* — Daniel J Rohrhoff
(74) *Attorney, Agent, or Firm* — Maschoff Brennan

(57) ABSTRACT

A goods presentation system includes a storage area on which a row of articles is to be arranged one behind the other. The storage area extends towards a removal position at which a foremost article of the row is to be removed from the storage area. A separating element that is displaceable between first and second positions includes front and back parts spaced apart from one another. The front part hinders removal of the foremost article from the storage area when the separating element is in the first position and permits removal thereof when the separating element is in the second position. The back part hinders another article of the row arranged on the storage area behind the foremost article from moving towards the removal position when the separating element is in the second position.

18 Claims, 6 Drawing Sheets

(56) References Cited

U.S. PATENT DOCUMENTS

| | | | | |
|---|---|---|---|---|
| 2013/0264917 | A1* | 10/2013 | Baptiste | E05B 65/462 29/428 |
| 2014/0299559 | A1* | 10/2014 | Bird | A47F 5/005 211/59.2 |
| 2015/0021283 | A1* | 1/2015 | Bruegmann | A47F 1/12 211/59.2 |
| 2017/0042343 | A1* | 2/2017 | Ewing | A47F 5/0838 |
| 2018/0360235 | A1* | 12/2018 | Hardy | A47B 57/583 |
| 2020/0085210 | A1* | 3/2020 | Pongrac | A47F 1/128 |
| 2022/0142378 | A1* | 5/2022 | Gulick, Jr. | A47F 7/28 |
| 2023/0233000 | A1* | 7/2023 | Welsh | A47F 3/002 312/114 |
| 2024/0407571 | A1* | 12/2024 | Hardy | A47F 1/126 |
| 2025/0113927 | A1* | 4/2025 | Siazon | A47F 3/002 |

FOREIGN PATENT DOCUMENTS

| | | | |
|---|---|---|---|
| DE | 195 35 045 | B4 | 1/2006 |
| DE | 20 2009 006 328 | U1 | 7/2009 |
| DE | 20 2012 104 649 | U1 | 3/2014 |
| FR | 2 489 792 | A1 | 3/1982 |
| FR | 2 581 304 | A1 | 11/1986 |
| JP | H08182586 | A | 7/1996 |
| WO | 94/24906 | A2 | 11/1994 |
| WO | 03/055360 | A1 | 7/2003 |
| WO | 2006/061009 | A1 | 6/2006 |

* cited by examiner

GOODS PRESENTATON SYSTEM WITH AT LEAST ONE SEPARATING ELEMENT

FIELD

The present invention relates to a goods presentation system, in particular for presenting goods at a point of sale.

BACKGROUND

Goods presentation systems including goods presentation assemblies with hooks for hanging goods or shelves for carrying goods at a point of sale are well-known. Typically, a display rack is provided at which such hooks and/or shelves are mounted. The goods (also referred to as articles herein), such as blister packs, bottles, or packages, hang or stand in rows side-by-side, in each row the same goods are arranged one behind the other.

Hanging goods may be slid along at least one elongated hook to a removal position at an end of the hook where goods may be removed from the hook. Usually, rather expensive goods like razor blades or cosmetic products are displayed at a point of sale by means of hooks. Those products shall be easily removable from a hook by a potential buyer. Furthermore, refilling the hooks with new goods shall also be rather simple. The same holds true for goods and thus products standing in rows on a shelf at a point of sale.

However, in practice such goods presentation systems are extremely prone to shoplifters since a great amount of expensive goods may be easily taken at the same time. In applicant's U.S. Pat. No. 7,768,399 a holder assembly for a goods presentation system is thus proposed which automatically determines a removal frequency at which goods are removed from a holding member. In case the determined removal frequency exceeds a threshold value an alarm signal is automatically emitted in order to indicate that an atypical removal of goods has occurred, i.e., a removal of many goods over a rather short period of time, which usually is a sign of a shoplifter grabbing several goods from the holder assembly. It is thus typical for an illicit removal that a large number of goods are taken from the holder assembly over a short period of time.

To prevent a purchased and thus removed product from permanently creating a gap, making sure that a subsequent good of a row of goods automatically replaces the one removed at the removal position is of importance. Sometimes this replacement is achieved by a pusher device arranged behind the last product in the row and equipped with a drive, for example a tensioned spring, so that after a foremost good has been removed, the resulting gap is closed by pushing the following goods forwards.

In addition to the attractive presentation of the individual goods or articles, particular attention is paid to protecting the respective articles against theft. On the one hand, it is known to electronically monitor the removal of goods and to draw conclusions about a possible theft attempt based on an atypical removal frequency—for example, if a large number of items are removed within a very short time.

In the case of shelf or goods hooks, on the other hand, where the individual products usually hang in a row on the hook and are pulled off the hook at a front end, it is known from WO 2006/061009 A1, for example, to provide a catch at the front end of the hook in order to allow only individual products to be removed. This also serves to protect against theft, as it prevents several products from being removed from a shelf hook at the same time.

In the case of articles arranged one behind the other on a shelf hardly any effective, non-electronic measures for preventing theft that do not interfere with the customer's proper removal of goods are known to date.

It is therefore the task of the present invention to provide a feed device for the automatic displacement of objects which is improved in this respect.

SUMMARY

Against this background a presentation system is proposed which comprises a storage area on which a row of article is to be arranged one behind the other, wherein the storage area extends towards the removal position at which a foremost article of the row of articles is to be removed from the storage area. The proposed goods presentation system further comprises a separating element which is displaceable between a first position (close or protection position) and a second position (open or access position), the separating element comprising at least one front part and at least one back part spaced apart from the front part. The at least one front part is displaceable between a regular position and refill position at the separating element (at least when the separating element is in its first position, i.e. that the front part may be adjusted from the regular position to the refill position when the separating element is located in its first position). In the regular position the at least one front part is configured to hinder removal of the foremost article from the storage area when the separating element is in the first position. In the regular position, the front part is furthermore configured to permit removal of the foremost article from the storage area when the separating element is in the second position. The at least one back part at the separating element is configured to hinder a further article of the row of articles arranged on the storage area behind the foremost article from moving towards the removal position when the separating element is in the second position. The at least one back part thus hinders a subsequent article following the foremost article in the row of articles from moving towards the removal position, for example along a longitudinal direction along which the articles are to be arranged one behind the other at the storage area, while the separating element is in the second position. In addition, the at least one front part is displaceable from the regular position into the refill position when the separating element is in the first position to permit refilling of the goods presentation system with new articles.

In a proposed goods presentation system the separating element fulfils several tasks simultaneously. On the one hand, in the first position of the separating element, the front part of the separating element makes it more difficult for a shoplifter to quickly remove articles from the goods presentation system without attracting attention, since the separating element has to be (manually) adjusted into its second position for removing the foremost article of the row of articles arranged at the goods presentation system. On the other hand, in the second position of the separating element, the separating element avoids that a subsequent article is immediately present at the removal position after the foremost article has been removed from the goods presentation system. Rather, the at least one back part of the separating element hinders the subsequent article from moving towards the removal position. The at least one back part may thus for example act as a stopper for blocking a subsequent article from moving towards the empty removal position when the separating element is displaced into its second position. In an exemplary embodiment, the at least one back part blocks or arrests the subsequent article so that the subsequent article is not displaceable at the storage area beyond a spacer position at a minimum distance to the removal position while the separating element is in its second position. In this way, the separating element ensures that only one article at a time can be removed from the storage area. This avoids the risk that a shoplifter can grab several articles from the goods presentation system at the same time.

While refilling of the goods presentation system passed the at least one front part is also impeded in the regular position of the at least one front part, the proposed adjustability of the at least one front part makes such refilling more convenient for personnel working at a point-of-sale. By making the at least one front part displaceable from the regular position into the refill position when the separating element is in the first position, a refilling of articles via a front of the goods presentation system (where the at least one front part is arranged) is facilitated.

The goods presentation system may include a locking device locking the at least one front part in its regular position at the separating element. The locking device may only be opened by authorized personnel to allow displacement of the at least one front part to the refill position. Via the locking device a displacement of the at least one front part at the separating element (and thus relative to a support member of the separating element at which the at least one front part is mounted) can therefore merely be permitted when actually a refilling of the storage area of the goods presentation system is intended. It is however also possible, that the at least one front part is always adjustable from its regular position into its refill position along a first direction of movement and backwards to the regular position along an opposite second direction of movement. In such an embodiment a movement of the at least one front part from the regular position along the first direction of movement may however be restricted to avoid easy accessibility of the storage area for a shoplifter by just moving the at least on front part away from the row of articles. In such an embodiment, the at least one front part is thus at least blocked from moving beyond the regular position in the second direction.

In an exemplary embodiment, the at least one front part is configured to block the foremost article from being grabbed by a person and removed from the goods presentation system, when the separating element is in the first position and the at least one front part is in the regular position. The at least one front part may then be in particular configured to block the foremost article from being grabbed by a person and pulled out from the goods presentation system when the separating element is in the first position and the at least one front part is in the regular position. Such a configuration may, for example, result in the requirement of the separating element to be firstly displaced from the first position to the second position before a person can manually grab a foremost article for removal from the removal position. In such an embodiment, a potential customer who wants to buy the foremost article placed in the goods presentation system has thus to firstly adjust the separating element to the second position before the foremost article is accessible at all or at least sufficiently accessible to remove the foremost article from the storage area.

In an alternative embodiment, the separating element is configured to be displaced from the first position towards the second position when a person, having manually grabbed the foremost article, removes the foremost article from the removal position. In such an embodiment, at least a portion of the foremost article remains accessible even when the separating element is in the first position and the at least one front part is in its regular position. A person is thus still allowed to reach to the foremost article and remove it from the storage area of the goods presentation device with the separating element being located in the first position. During the removal of the foremost article, however, the separating element is mandatorily displaced from the first position towards the second position thereby hindering a subsequent article in the row of articles from moving towards the removal position.

Generally, the separating element may for example be pivotable between the first and second positions. The separating element may thus be pivotably mounted at a support structure of the goods presentation system so as to be displaceable about a pivot axis between the first and second positions.

In an exemplary embodiment, the at least one front part is pivotably mounted at the separating element so that the at least one front part may swivelled between the regular position and the refill position about a front part pivot axis. The front part pivot axis about which the at least one front part is pivotable at the separating element may for example run parallel to a pivot axis about which the separating element is the pivotable between the first and second positions. This may in particular include that the at least one front part is configured to be pivoted (as for example seen in a side view of the goods presentation system) about the front part pivot axis in the counterclockwise direction to displace the front part from the regular position towards the refill position while the separating element is configured to be pivoted about its parallel pivot in a clockwise direction to displace the separating element from the first position towards the second position. While the at least one front part may thus be for example swivelled backwards to allow a refilling of articles, the separating elements may be swivelled forwards to be displaced from the first position towards the second position for allowing removal of a foremost article from the storage area.

As already outlined above, the at least one back part of the separating element may be configured to, when the separating element is and maintains the second position, block the further/subsequent article from reaching the removal position when the foremost good is removed from the goods presentation system. For such a blocking, for example including a holding or arresting the further/subsequent article, the at least one back part may be configured to engage with at least a portion of the further/subsequent article when the separating element is adjusted into its second position.

In an exemplary embodiment, the proposed goods presentation system may be configured to accommodate beverage cans as articles and thus at least one row of beverage cans. The at least one back part may then be spaced from the front part of the separating element at a distance so as to block, in the row of beverage cans and as long as the separating element maintains the second position, the further/subsequent beverage can from reaching the removal position when the foremost beverage can is removed from the goods presentation system. The further/subsequent beverage can can thus not be moved beyond a certain spacer position due to the at least one back part. For example, the at least one back part may be configured to reach beyond a protruding ring portion surrounding a top of the further beverage can when the separating element is in the second position.

In an exemplary embodiment, the at least one back part is at least partially flexible. The at least one back part may thus for example the made of a flexible material such as rubber. The at least one back part may also not be merely flexible but elastic.

In a further exemplary embodiment, the goods presentation system comprises at least two back parts at the separating element. These at least two back parts are spaced apart from each other at the separating element. The presence of at least two back parts at the separating element allows more flexibility in using a proposed goods presentation system for different types of articles. A configuration with at least two back parts may make sure that always for at least one of the at least two back parts block a subsequent article from moving towards the removal position. Multiple (at least two) backup parts may also be made at least partially flexible in order to further facilitate using the proposed goods presentation system with different sizes of articles and/or types of articles (e.g., cans, bottles, flacons, blister packs, cardboard boxes, packets, etc.) to be arranged at the at least one storage area.

In an exemplary embodiment the goods presentation system may comprise at least one of (a) a driven pusher device at the storage area for pushing articles of the row of article towards the removal position, (b) a sliding surface at the storage area configured to permit sliding of articles of the row of articles deposed on the sliding surface towards the removal position, and (c) one or more rolling elements at the storage area configured to permit sliding of articles disposed on the one or more rolling elements towards the removal position.

With a driven pusher device, articles of a row of articles are actively biased towards the removal position. When the foremost article is removed from the storage area, the pusher device pushes the subsequent articles forward for closing a gap created by the removed foremost article. A corresponding pusher device may for example be driven by a coil spring. In case the goods presentation system comprises a sliding surface without or with one or more rolling elements at the storage area, an automatic movement of articles of a row of articles arranged at the storage area towards the removal position may of course also be realized by a driven pusher device.

Alternatively, a gravity-driven movement is possible. Upon a gravitational force acting on each article disposed on the sliding surface and/or on one or more rolling elements, each article automatically moves forward when a gap is created by removing the foremost article from the storage area. In such an embodiment, the sliding surface without or with one or more rolling elements of the goods presentation device may be configured to be arranged in an inclined orientation at a point-of-sale.

Generally, the separating element part may be configured to be adjusted back to its first position from the second position under the effect of gravity. In case a user no longer holds the separating element in the second position the separating element returns to its first position due to gravity acting on the displaced separating element. In one exemplary embodiment, the goods presentation system may comprise at least one return element for automatically adjusting the separating element to the first position. The at least one return element may provide a force biasing the separating element towards the first position. A corresponding biasing force may result in a person having to manually apply a counterforce exceeding the biasing force for displacing the separating element from the first position to the second position. A return element may for example comprise a hydraulic member and/or a spring.

In one embodiment with at least one return element, the at least one return element may be configured to automatically adjust the separating element (back) to its first position a predetermined time after the separating element reached the second position. After a determined time, for example of at least 2 seconds, in particular 3, 4 or 5 seconds and/or less than 8 or 10 seconds, the at least one return element moves the separating elements back to the first position. Thereby, the separating element maintains the second position just for a certain duration but not endlessly after a person no longer holds the separating element in the second position. The separating element hence does not immediately return to the first position when a person quits holding the separating element in the second position but rather remains at least a predefined duration in the second position for increasing customer comfort for removing articles from the storage area.

The goods presentation system may also comprise at least one sensor element for electronically detecting a displacement of the separating element from the first position towards the second position. The at least one sensor element may thus in particular be provided for detecting the removal of a foremost article from the storage area upon which the displacement of the separating element to the second position is mandatory. The at least one sensor element may be configured to generate at least one electronic detection signal when a displacement of the separating element at least towards the second position or into the second position is detected. Based on such an electronic detection signal it may for example be evaluated whether and how often articles are removed from the storage area.

In addition or in the alternative, a filling level of the goods presentation system may be monitored based on at least one detection signal of the sensor element. Accordingly, the at least one sensor element or an additional sensor element may be provided for detecting when the at least one front part is displaced from its regular position towards it refill position to electronically determine when one or more new articles are placed at the storage area.

The at least one electronic detection signal may trigger output of at least one of an audible tone and/or a visual notification at the goods presentation system. For example, upon an electronic detection of a displacement of the separating element from the first position towards the second position an audible tone and/or visual notification at the goods presentation system may be emitted. The audible tone and/or the visible notification may make other customers or staff at the point of sale aware of an article taken from the goods presentation system. An audible tone may for example be output from a sound emitting device, such as a speaker, of the goods presentation system. A visual notification may be output by a light emitting element or display element at the goods presentation system.

Based on the at least one electronic detection signal, an alarm may be triggered when the number of electronic detection signals during a given period of time exceeds a threshold value. An alarm device of the goods presentation system or an alarm device, e.g., wirelessly, coupled to the goods representation system may then be configured to determine an atypical removal frequency of articles for generating the alarm. An alarm may thus for example be generated if a number of electronic detection signals exceeds the threshold value for an atypical removal frequency. The threshold value may for example be 3 detection signals in 5 seconds, 5 detection signals in 20 seconds, 7 detection signals in 30 seconds or 10 detection signals in 45 seconds.

A generated alarm may for example be output at a mobile device and/or a surveillance system, e.g., wirelessly, coupled to the goods presentation system. A surveillance system may comprise at least one camera to capture images of the goods presentation system in response to the generation of the alarm. In one embodiment, the surveillance system may comprise at least one robot that is controlled to move to the goods presentation system in response to the generation of the alarm.

The at least one sensor element may include at least one of an acceleration sensor, an inertial measurement unit (IMU), and a vibration sensor. The sensor element may be disposed on the separating element or may be disposed on a support structure to which the separating element is mounted. In case of a vibration sensor mounted to a support structure of the goods representation system, the vibration sensor may for example generate an electronic detection signal if a sufficient vibration of the support structure is detected upon displacing the separating element pivotable mounted to the support structure. In an embodiment the vibration sensor may generate the electronic detection signal if a sufficient vibration of the support structure is detected upon displacing one separating element of a plurality of separating elements mounted to the support structure for a plurality of rows of articles to the arranged at the good presentation system.

The proposed goods presentation system may for example comprise a shelf at which multiple (at least two) rows of articles are arranged next to each other. For each row at the shelf the goods presentation system may comprise a separating element with at least one front part and in at least one back part. For the different rows, compartments may be provided at the goods presentation system with separate storage areas for different types of articles to be respectively arranged in a row of articles.

A further aspect of the proposed solution relates to a goods presentation system comprising a storage area on which a row of beverage cans is to be arranged one behind the other, wherein the storage area extends towards a removal position at which a foremost beverage can of the row of beverage cans is to be removed from the storage area. The storage area is furthermore configured for a gravity-driven sliding of the beverage cans towards the removal position (for example using a continuous sliding surface at the storage area and/or a sliding surface defined by one or more rolling elements, wherein in the latter case the beverage cans can slide along the sliding surface under rotation of the one or more rolling elements). The goods presentation system further comprises a separating element which is displaceable between a first position and a second position, wherein the separating element comprises at least one front part and at least one back part spaced apart from the front part. The at least one front part is configured to hinder removal of the foremost beverage can from the storage area when the separating element is in the first position and to permit removal of the foremost beverage can from the storage area when the separating element is in the second position. The at least one back part is configured to hinder a further (subsequent) beverage can of the row of beverage cans arranged on the storage area behind the foremost beverage can from moving towards the removal position when the separating element is in the second position.

BRIEF DESCRIPTION OF THE DRAWINGS

The previously mentioned and other advantages of the present solution will be apparent to those skilled in the art upon consideration of the following specification and the attached drawings.

DETAILED DESCRIPTION

Figure 1A:
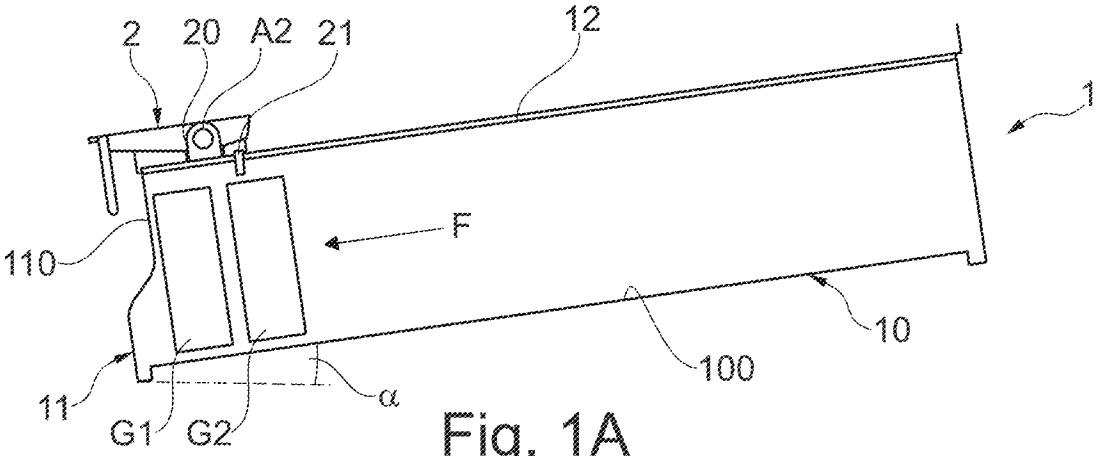
FIG. 1A shows a side view of an embodiment of the proposed goods presentation system comprising a separating element for allowing removal of one article at a time from a storage area of the goods presentation system with an inclined sliding surfaces for our row of articles.

FIG. 1A shows a side view of a goods presentation system 1 to be arranged for example on a shelf of a display rack at a point-of-sale, such as in a supermarket or drugstore. The goods presentation system 1 comprises a storage area 10 for accommodating at least one row of goods/articles of which two articles G1 and G2 are depicted in FIG. 1A. The articles G1 and G2, which may for example be cans, bottles, flacons, blister packs, cardboard boxes, packets, or the like, are arranged on a sliding surface 100 of the storage area 10 of the goods presentation system 1. The sliding surface 100 defines a plain area inclined with respect to a horizontal axis by an inclination angle $\alpha$. For example, the inclination angle $\alpha$ is in the range of 5° to 10°. Due to the inclination of the sliding surface, the articles G1, G2, under a resulting gravitational force F, slide towards a front portion 11 of the goods presentation system 1. To facilitate a sliding movement under the resulting gravitational force F acting on each article G1, G2, the sliding surface 100 may be made of a friction-reducing material or it may be coated with a friction-reducing material, such as polyoxymethylene (POM).

The front portion 11 of the goods presentation system 1 stops a sliding movement of the foremost article G1 of the row of articles and thereby defines a removal position for the foremost article G1 where the foremost article G1 is accessible for a customer and from where the customer may remove the foremost article G1 from the storage area 10. The front portion 11 further defines an opening 110 through which an upper part of the foremost article G1 may be accessed by a customer and manually pulled out from the storage area 10. A lower part of the front portion 11 below the opening 110 may for example carry a tag with product information on the articles G1, G2 and/or a product price.

At an upper support structure 12 (e.g., an upper shelf, a cross bar or a wire hook) of the goods presentation system 1 a separating element in the form of a swivel lever 2 is pivotably mounted. The swivel lever 2 is arranged above the sliding surface 100 and may be swivelled about a pivot axis A2 running perpendicular to a direction of movement along which the articles G1, G2 slide along the sliding surface 100 towards the front portion 11. In the illustrated example, the pivot axis A2 of the swivel lever 2 runs also parallel to the sliding surface 100.

Figure 1B:
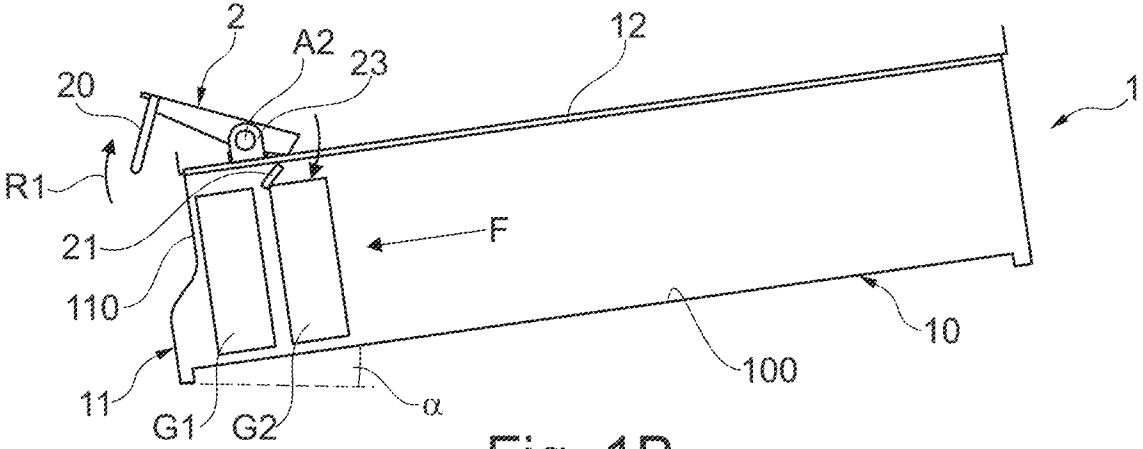
FIG. 1B shows the side view of FIG. 1A with the separating element displaced from a first position shown in FIG. 1A to a second position.

In FIG. 1A the swivel lever 2 is in a first position (also considered as a close or protection position herein). In this first position a front part of the swivel lever 2 in the form of a plate-like theft prevention member 20 at least partially covers the opening 110. Thereby, the theft prevention member 20 hinders access to the foremost article G1 and blocks removal of the foremost article G1 from the storage area 10. Before the foremost article G1 is sufficiently accessible and may be manually removed from the storage area 10, a person has thus to firstly swivel the swivel lever 2 about the pivot axis A2 into a second position as shown in FIG. 1B. In the second position of the swivel lever 2 (also considered as an open or access position herein), the theft prevention member 20 no longer extends in front of the opening 110 and thus makes the opening 110 fully accessible for a person. The foremost article G1 may thus be manually grabbed and pulled out from the storage area 10.

Under the resulting gravitational force F, the subsequent article G2 arranged behind the foremost article G1 would immediately replace the foremost article G1 after its removal from the storage area 10. In the illustrated goods presentation system 1 however the subsequent article G1 is blocked from moving towards the emptied removal position after the foremost article G1 has been removed from the storage area 10 by a back part 21 of the swivel lever 2. The back part is provided in the form of an arresting member or stopper 21 at the swivel lever 2. While the theft prevention member 20 is located at a first end of the swivel lever extending in a forward direction from the pivot axis A2, the stopper 21 is located at a second end of the swivel lever 2 extending in an opposite rearward direction from the pivot axis A2. The stopper 21 is thus spaced apart from the theft prevention member 20 but is configured to move together with the theft prevention member 20.

When the swivel lever 2 is displaced towards its second position by swivelling in a pivoting direction R1 the theft prevention member 20 at the front of the goods presentation system 1 moves upwards. At the same time the stopper 21 moves downwards within the storage area 10 so as to protrude into an adjustment path of the subsequent article G2. Thereby, the stopper 21 provides a stop the subsequent article G2 hits and cannot pass when moving towards the front portion. The downwardly pivoted stopper 21 may even—for example depending on the size and/or position of the subsequent article—engage with the subsequent article G2 to block its movement towards the front portion 11 as long as the swivel lever 2 is located in the second position. In any event, the stopper 21 blocks the subsequent article G2 from moving beyond a spacer position within the storage area distanced to a removal position at a front of the goods presentation device 1 so as to prevent the subsequent article G2 from reaching a removal position at the front of the storage area 10 while the swivel lever 2 is in its second position and has not returned to the first position. The goods presentation system 1 of FIGS. 1A and 1B therefore merely allows removing one article at a time from the storage area 10.

For automatically returning the swivel lever 2 from its second position shown in FIG. 1B back to its first position shown in FIG. 1A a return element in the form of a return spring 23 may be provided biasing the swivel lever 2 towards the first position. Generally, the swivel lever 2 may be configured to be adjusted back to its first position from the second position just under the effect of gravity. In case a user no longer holds the swivel lever 2 in the second position the swivel lever 2 returns to its first position due to gravity acting on the displaced swivel lever 2. The return spring 23 may provide for an supplemental and more defined biasing towards the first position.

Figure 2:
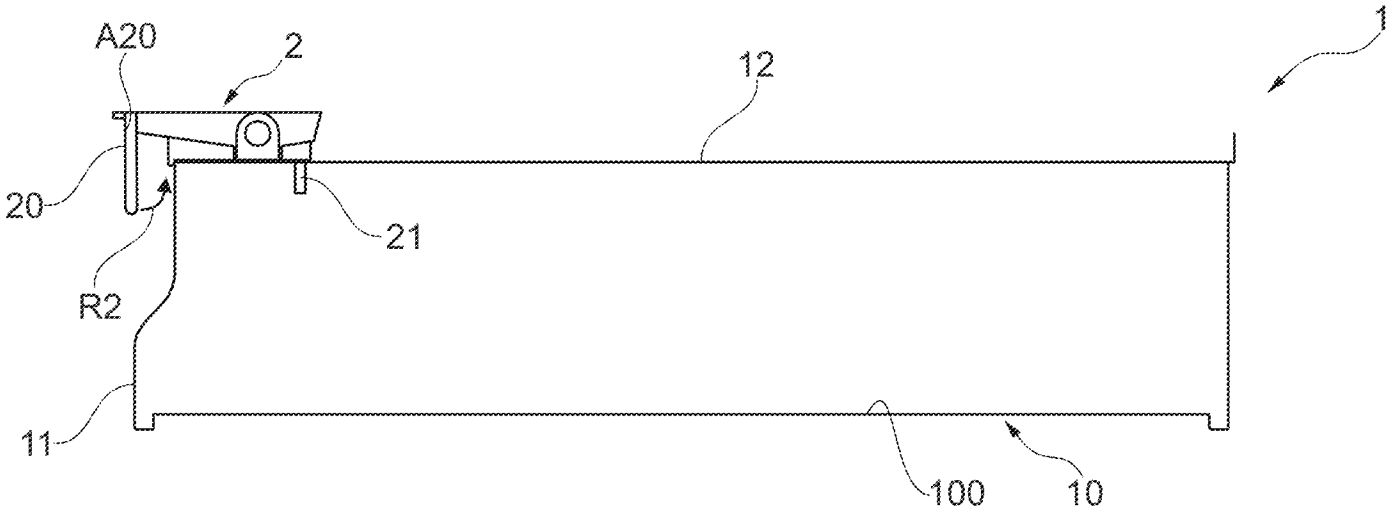
FIG. 2 shows the goods presentation system of FIGS. 1A and 1B illustrating adjustability of a front part of the separating element for refilling purposes.

As illustrated in the side view of FIG. 2, the goods presentation system 1 of FIGS. 1A and 1B allows for a convenient refilling of the storage area 10 with new articles. The theft prevention member 20 is pivotably mounted at the swivel lever 2 about a front part pivot axis A20. Thereby, the theft prevention member 20 may be displaced from a regular position shown in FIGS. 1A and 1B into a refill position at the swivel lever 2. When the swivel lever 2 is in its first position, the theft prevention member 20 may be swivelled into its refill position and thus folded backwards, thereby giving access to the opening 110 for refilling the storage area 10 with new articles via the front of the goods presentation system 1. In the embodiment shown in FIG. 2, the theft prevention member 20 may be swivelled about the front part pivot axis A20 at the swivel lever 2 backwards in direction of the stopper 21 along a pivoting direction R2. This pivoting direction R2 for displacing the theft prevention member 20 from its regular position to its refill position is opposite to the pivoting direction R1 for displacing the swivel lever 2 from its first position to its second position. In the side views of FIGS. 1A, 1B and 2 the pivoting direction R1 for the swivel lever 2 thus runs clockwise while the pivoting direction R2 for the theft prevention member 20 runs counter-clockwise.

Figure 3:
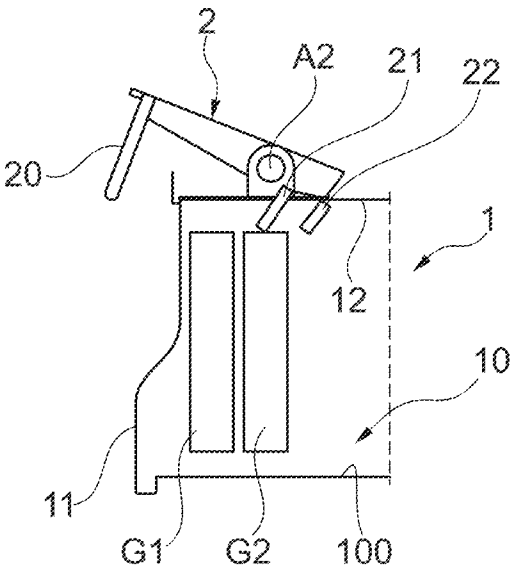
FIG. 3 shows an enlarged view of a further embodiment having a separating element with two back parts.

As illustrated in the enlarged view of FIG. 3 for a further embodiment, the swivel lever 2 may also be provided with multiple stoppers 21 and 22. Different stoppers 21, 22 spaced apart from each other may facilitate the use of the goods presentation system 1 with different types of articles G1, G2. Irrespective of the size of the articles arranged in the storage area 10, as long as the swivel lever 2 is in its second position, at least one of the stoppers 21, 22 blocks a subsequent from moving towards the removal position when the foremost article is removed.

Figure 4B:
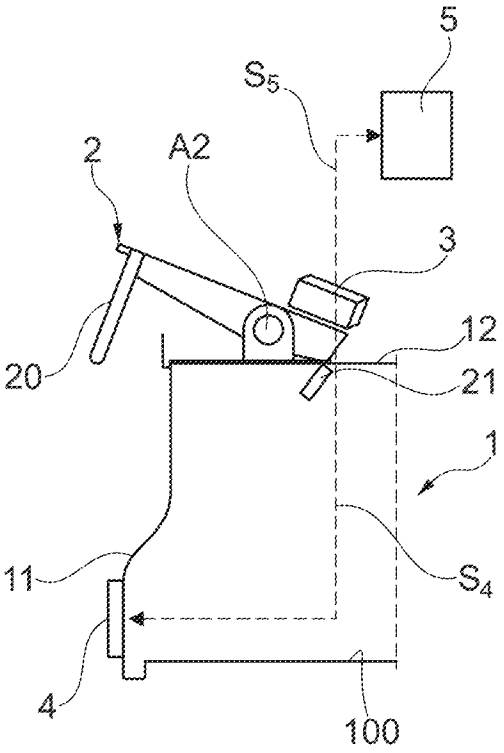
FIG. 4B shows the embodiment of FIG. 4A with the separating element displaced into its second position.
Figure 4A:
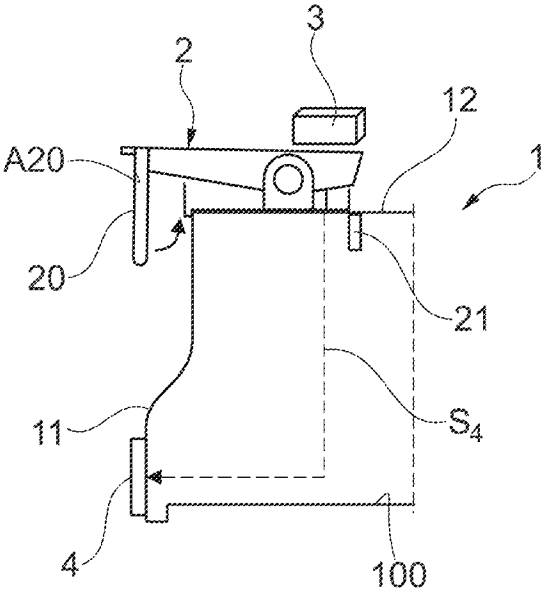
FIG. 4A shows an enlarged view of a further embodiment with a sensor element at the separating element for electronically detecting movement of the separating element and/or the front part of the separating element.

As illustrated in FIGS. 4A and 4B, the goods presentation device 1 may furthermore include a sensor element in the form of the displacement sensor 3, e.g., including at least one of an acceleration sensor, an IMU, and vibration sensor. Such a displacement sensor 3 may detect movement of the swivel lever 2 into its second position and/or movement of the theft prevention member 20 from its regular position into its refill position. The displacement sensor 3 may for example be at least partially disposed on the swivel lever 2 or the support structure 12. For example, a vibration sensor of the displacement sensor 3 that is disposed on the support structure 12 may detect a characteristic vibration of the support structure 12, when the swivel lever 2 is adjusted from the first position into the second position without the need of having the displacement sensor directly mounted to the swivel lever 2. Via a single displacement senor 3 at the support structure 12 also a plurality of swivel levers 2, that is mounted to the support structure 12 for several rows of articles, may thus be monitored since every adjustment of a swivel lever 2 results in a characteristic vibration at the support structure 12.

Generally, on the basis of electronic signals $S_4$, $S_5$ of the displacement sensor 3 it may be detected when and how often an article is removed from the storage area 10 of the goods presentation system and/or when new articles are arranged in the storage area 10 for refilling the goods presentation system 1.

An electronic detection signal $S_4$ may for example be generated to trigger generation of an audible tone and/or a visual notification at the goods presentation system 1 via and audio/light emitting device 4. In the embodiment shown in FIGS. 4A, 4B a corresponding device 4 is arranged at the front portion 11. Such a device 4 may for example comprise at least one of a speaker, a light emitting element and display element.

A further electronic detection signal $S_5$ may also be generated by the displacement sensor 3 and sent to a remote alarm/monitoring device 5. Such an alarm/monitoring device 5 may for example be configured to determine a removal frequency resulting from consecutive movements of the swivel lever 2 from its first position into its second position over a certain time period. In case a determined removal frequency exceeds a threshold, an alarm is triggered indicating an atypical removal of a plurality of articles from the goods presentation system and thus is likely a potential theft of articles.

It is of course also possible that the displacement sensor 3 already includes an evaluation unit, for example provided by a microcontroller, for determining a removal frequency and comparing it with a threshold value to trigger generation of an alarm signal $S_4$, $S_5$ merely for indicating a potential theft. An audible tone and/or a visual notification is then for example only emitted at the audio/light emitting device 4 and/or the device 5 after the threshold value was exceeded and an alarm is to be output. A threshold value may for example be 3 detection signals in 5 seconds, 5 detection signals in 20 seconds, 7 detection signals in 30 seconds or 10 detection signals in 45 seconds.

Figure 5:
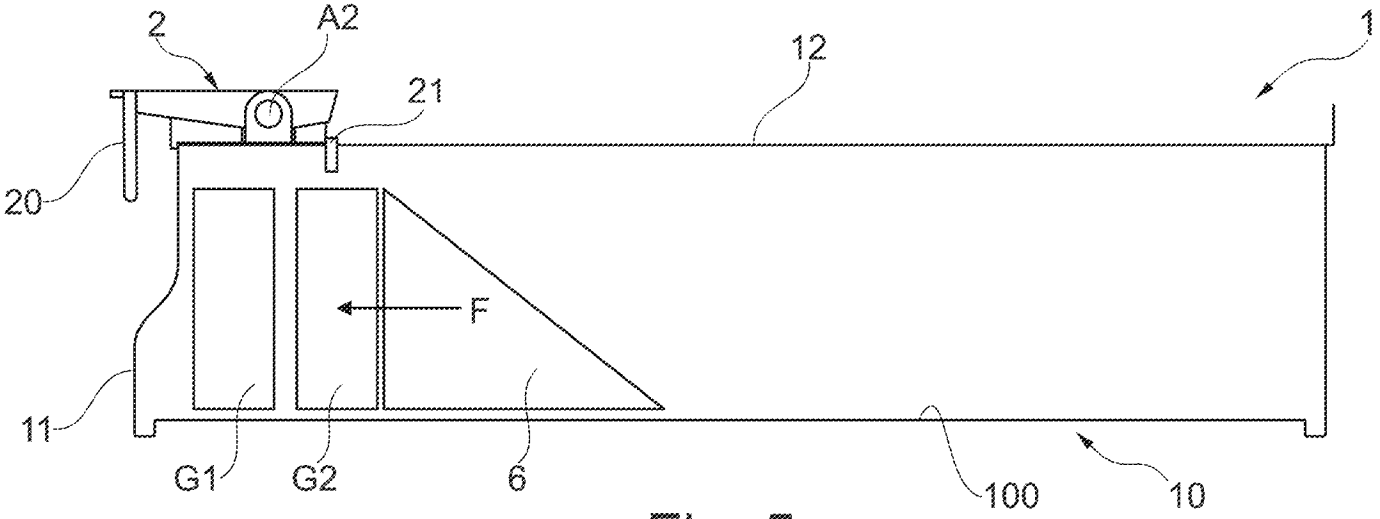
FIG. 5 shows a side view of a further embodiment of a proposed goods presentation system including a driven pusher device for actively pushing articles at the storage area towards a front of the goods presentation system where a removal position is defined.

FIG. 5 depicts an embodiment of the goods presentation system 1 including a driven pusher device 6. This pusher device 6 is arranged on the sliding surface 100 at the storage area 10. The pusher device 6 applies a pushing force F on the rearmost article of a row of articles G1, G2 arranged at the storage area 10. The pusher device 6 thus automatically pushes articles towards the front portion 11 if the foremost article G1 is removed from the storage area—as long as not blocked by the swivel lever 2 being in its second position.

Figure 6A:
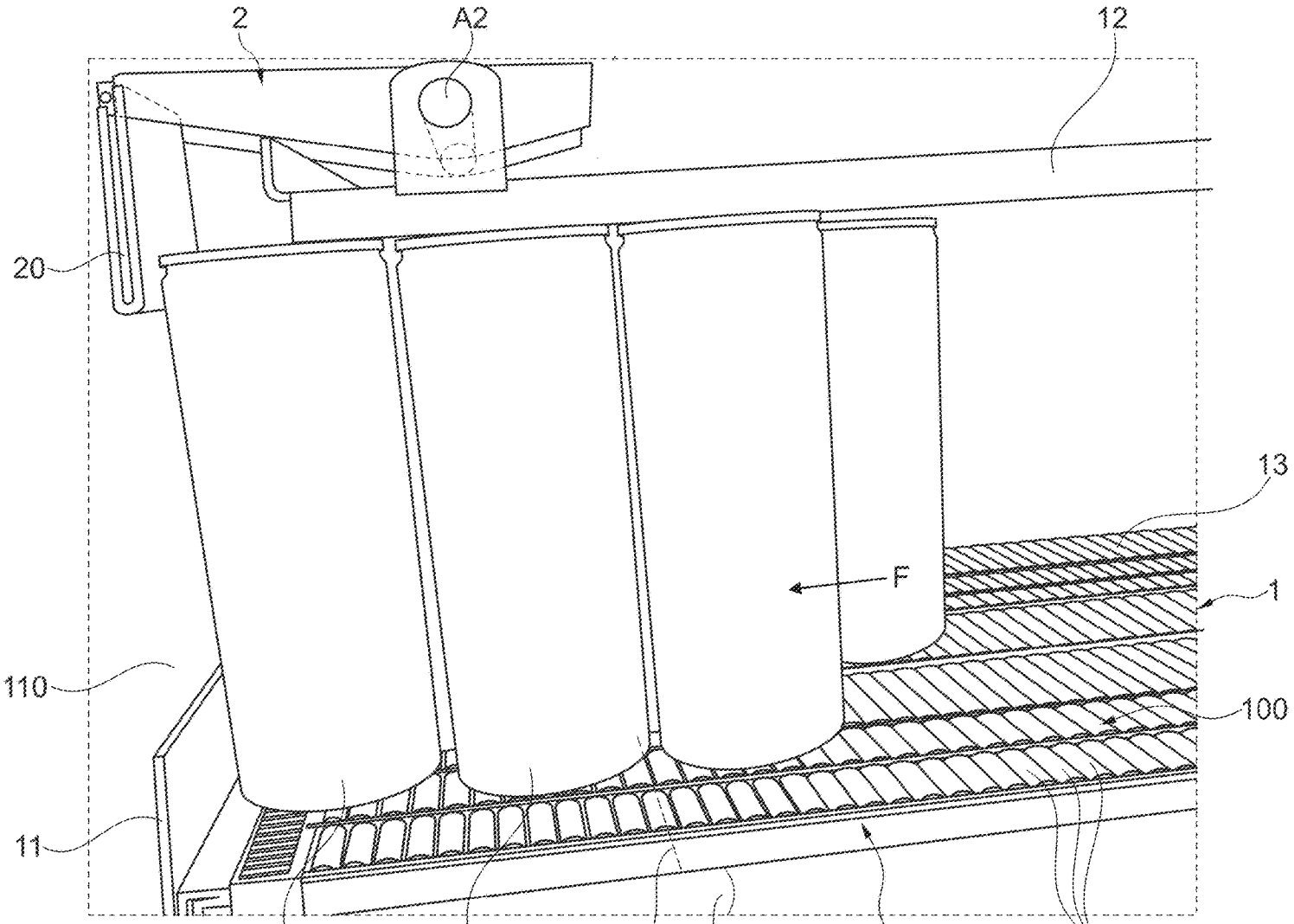
FIG. 6A shows a further embodiment of a proposed goods presentation system on whose storage area rows of beverage cans are arranged, with the separating element in its first position.
Figure 6B:
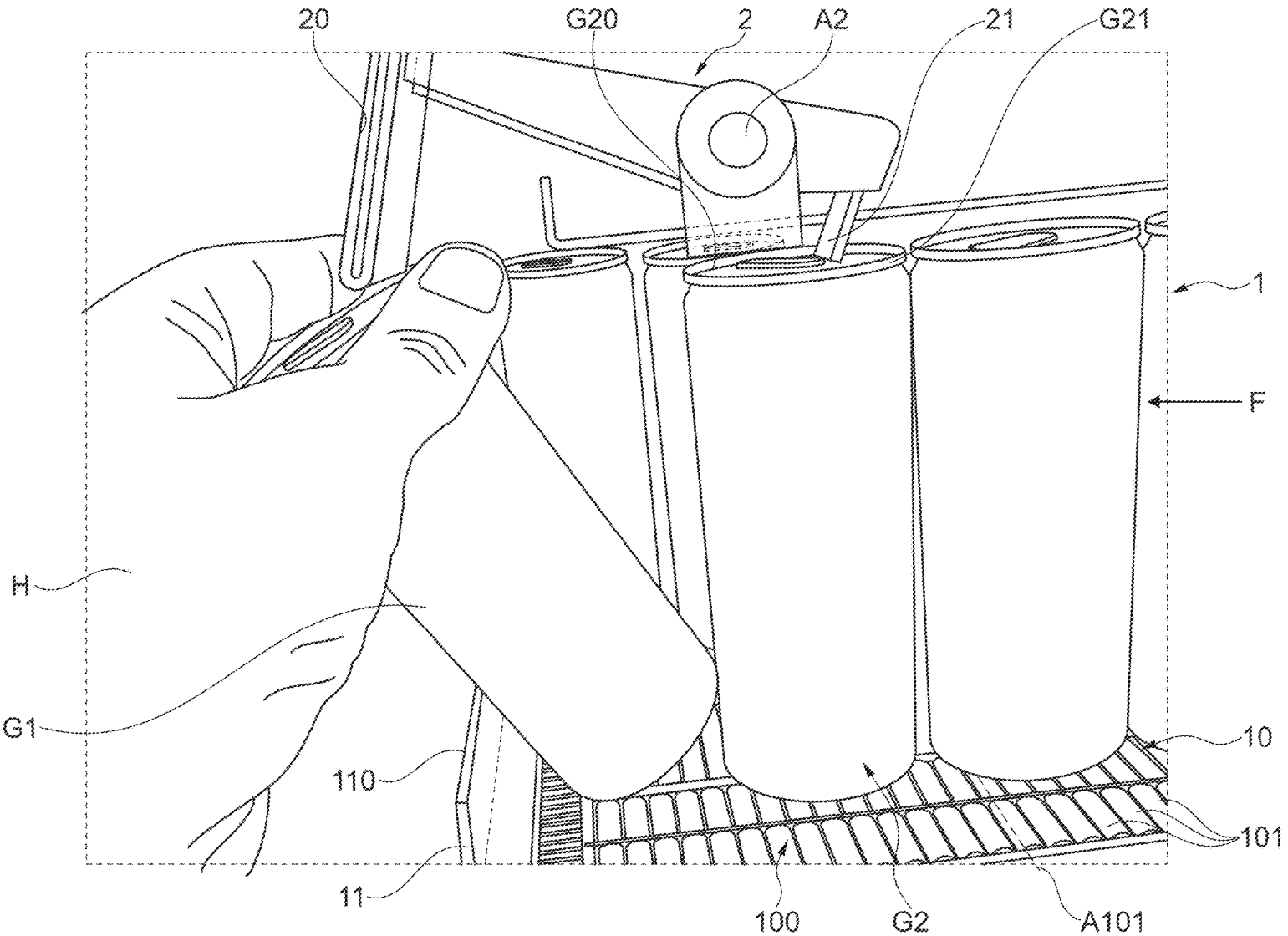
FIG. 6B shows the goods presentation system of FIG. 6A with the separating element in its second position for removal of a foremost beverage can from the goods presentation system.

FIGS. 6A and 6B illustrate a further embodiment of the proposed goods presentation system 1 which is configured for accommodating several rows of beverage cans G1, G2 at a storage area 10. The storage area 10 of the goods presentation system 1 illustrated in FIGS. 6A and 6B provides for several separate compartments for several rows of beverage cans G1, G2, where the compartments are respectively separated by a side wall 13 from each other.

Each row of beverage cans G1, G2 is to be arranged on a portion of an inclined sliding surface 100 of the storage area 10, wherein the sliding surface 100 of the goods presentation system 1 illustrated in FIGS. 6A and 6B is defined by a plurality of rolling elements in the form of roller bars 101. Each of these roller bars 101 is rotatably mounted about a rotation axis A101 running perpendicular to a sliding direction of the beverage cans G1, G2 within the storage area 10. Each beverage can G1, G2 thus slides towards the front portion 11 of the goods presentation system 1 of FIGS. 6A, 6B on the inclined sliding surface 100 under rotation of the roller bars 101 on which the beverage cans G1, G2 are disposed.

Like in the previously described embodiments of FIGS. 1A, 1B, 2, 3, 4A, 4B, and 5, the goods presentation system 1 of FIGS. 6A and 6B includes a swivel lever 2 for merely allowing one foremost beverage can G1 to be removed from the storage area 10 at a time. As in particular illustrated in FIG. 6B, a customer may reach the foremost beverage can G1 through an opening 110 provided between a bottom part of the front portion 11 and the theft prevention member 20 of the swivel lever 2 (when the swivel lever 2 is in its first position). The customer may thus reach with its hand H through the opening 110 to grab the foremost beverage can G1. However, pulling the foremost beverage can G1 out of the storage area 10 is merely possible when the swivel lever 2 is swivelled into its second position resulting in a swivel movement of the theft prevention member 20 upwards for increasing the size of the opening 110. Generally, the theft prevention member 20 may partially cover the opening 110 for hindering removal of a foremost beverage can G1 from one compartment or may be dimensioned and configured to partially cover the opening 110 for hindering removal of at least two foremost beverage cans G1 from two compartments next to one another.

With the swivel lever 2 being in its second position as illustrated in FIG. 6B a stopper 21 at the other end of the swivel lever 2 is moved downwards. With this downward movement the stopper 21 of the swivel lever 2 engages with a top G20 of a subsequent beverage can G2. In the shown embodiment, the stopper 21 extends into the recessed area at the top G20 of the subsequent beverage can G2 which surrounded by a ring portion G21. The stopper 21 thus blocks movement of the subsequent beverage can G2 from moving towards the removal position under the resulting gravitational force F when the foremost beverage can G1 is pulled out of the storage area 10. Merely after a return of the swivel lever 2 to its first position and the accompanying movement of the stopper 21 upwards the subsequent beverage can G2—and any beverage cans behind it—are allowed to move towards the front portion 11 under rotation of the roller bars 101. Thereby, the previous subsequent beverage can G2 becomes the new foremost beverage can of the rows of beverage cans arranged in the storage area 10.

The goods presentation system 1 of FIGS. 6A and 6B may also be provided with an additional stopper 22 at the second end of the swivel lever 2 and/or with a displacement sensor 3, as illustrated in FIGS. 3 and 4A-4B. In the goods presentation system 1 of FIGS. 6A and 6B the theft prevention member 20 may also be pivotably mounted so as to be adjustable from a regular position (as shown in FIGS. 6A, 6B) and a refill position for facilitating refilling the goods presentation system 1 of FIGS. 6A and 6B with new beverage cans.

The foregoing description of the embodiments has been provided for purposes of illustration and description. It is not intended to limit the disclosure. Individual elements or features of a particular embodiment are generally not limited to that particular embodiment, but, where applicable, are interchangeable and can be implemented in another embodiment, even if not specifically shown or described. The same elements may also be varied in one or more ways. Such variations are not to be regarded as a departure from the disclosure, and all such modifications are intended to be included within the scope of the disclosure.

The invention claimed is:

1. A goods presentation system, comprising:

a storage area on which a row of articles is to be arranged one behind the other, the storage area extending towards a removal position at which a foremost article of the row of articles is to be removed from the storage area; and a separating element which is displaceable between a first position and a second position, wherein the separating element comprises at least one front part, which is displaceable between a regular position and a refill position at the separating element, and at least one back part spaced apart from the front part, wherein in the regular position the at least one front part is configured to hinder removal of the foremost article from the storage area when the separating element is in the first position and to permit removal of the foremost article from the storage area when the separating element is in the second position, wherein the at least one back part is configured to hinder a further article of the row of articles arranged on the storage area behind the foremost article from moving towards the removal position when the separating element is in the second position, and wherein the at least one front part is displaceable from the regular position into the refill position when the separating element is in the first position to permit refilling of the goods presentation system with new articles, wherein the at least one front part is pivotably mounted at the separating element to be pivotable between the regular and refill position, wherein the at least one front part is pivotably mounted at the separating element about a front pivot axis running parallel to a further pivot axis about which the separating element is pivotable between the first and second positions.

2. The goods presentation system of claim 1, wherein the at least one front part is configured to block the foremost article from being grabbed by a person and removed from the goods presentation system, when the separating element is in the first position and the at least one front part is in the regular position.

3. The goods presentation system of claim 2, wherein the separating element is configured to be displaced from the first position to the second position before a person can manually grab the foremost article for removal from the removal position.

4. The goods presentation system of claim 1, wherein the separating element is configured to be displaced from the first position towards the second position upon a person, having manually grabbed the foremost article, removing the foremost article from the removal position.

5. The goods presentation system of claim 1, wherein the separating element is pivotable between the first and second positions.

6. The goods presentation system of claim 1, wherein the at least one front part is configured to be pivoted about the front pivot axis in a counter-clockwise direction to displace the at least one front part from the regular position towards the refill position while the separating element is configured to be pivot about the further pivot axis in a clockwise direction to displace the separating element from the first position towards the second position.

7. The goods presentation system of claim 1, wherein the at least one back part is configured to block the further article from reaching the removal position when the foremost good is removed from the goods presentation system while the separating element maintains the second position.

8. The goods presentation system of claim 1, wherein the at least one back part is at least partially flexible.

9. The goods presentation system of claim 1, wherein at least two back parts are provided spaced apart from each other at the separating element.

10. The goods presentation system of claim 1, further comprising at least one of:

a driven pusher device at the storage area for pushing the articles of the row of articles towards the removal position;

a sliding surface at the storage area configured to permit sliding of articles of the row of articles disposed on the sliding surface towards the removal position; and one or more rolling elements at the storage area configured to permit sliding of articles of the row of articles disposed on the one or more rolling surface towards the removal position.

11. The goods presentation system of claim 1, wherein the goods presentation system comprises at least one return element for automatically adjusting the separating element to the first position or the separating element is configured to be automatically adjusted from the second position to the first position under the effect of gravity when a person no longer holds the separating element in the second position.

12. The goods presentation system of claim 11, wherein the at least one return element provides for a force biasing the separating element towards the first position.

13. The goods presentation system of claim 11, wherein the at least one return element is configured to automatically adjust the separating element to the first position a predetermined time after the separating element reached the second position.

14. The goods presentation system of claim 1, wherein the goods presentation device comprises at least one sensor element for detecting a displacement of the separating element from the first position towards the second position.

15. The goods presentation system of claim 14, wherein the at least one sensor element includes at least one of an acceleration sensor, an inertial measurement unit or a vibration sensor.

16. A goods presentation system, comprising:

a storage area on which a row of articles is to be arranged one behind the other, the storage area extending towards a removal position at which a foremost article of the row of articles is to be removed from the storage area; and a separating element which is displaceable between a first position and a second position, wherein the separating element comprises at least one front part, which is displaceable between a regular position and a refill position at the separating element, and at least one back part spaced apart from the front part, wherein in the regular position the at least one front part is configured to hinder removal of the foremost article from the storage area when the separating element is in the first position and to permit removal of the foremost article from the storage area when the separating element is in the second position, wherein the at least one back part is configured to hinder a further article of the row of articles arranged on the storage area behind the foremost article from moving towards the removal position when the separating element is in the second position, and wherein the at least one front part is displaceable from the regular position into the refill position when the separating element is in the first position to permit refilling of the goods presentation system with new articles, wherein the articles are beverage cans and the at least one back part is spaced from the front part at a distance so as to block in the row of beverage cans the further beverage can from reaching the removal position when the foremost beverage can is removed from the goods presentation system while the separating element maintains the second position.

17. The goods presentation system of claim 16, wherein the at least one back part is configured to reach beyond a protruding ring portion surrounding a top of the further beverage can while the separating element maintains the second position.

18. A goods presentation system, comprising:

a storage area on which a row of beverage cans is to be arranged one behind the other, the storage area extending towards a removal position at which a foremost beverage can of the row of beverage cans is to be removed from the storage area and configured for a gravity-driven sliding of the beverage cans towards the removal position; and a separating element which is displaceable between a first position and a second position, wherein the separating element comprises at least one front part and at least one back part spaced apart from the front part, wherein the at least one front part is configured to hinder removal of the foremost beverage can from the storage area when the separating element is in the first position and to permit removal of the foremost beverage can from the storage area when the separating element is in the second position, wherein the at least one back part is configured to hinder a further beverage can of the row of beverage cans arranged on the storage area behind the foremost beverage can from moving towards the removal position when the separating element is in the second position.

* * * * *